US008926392B2

(12) United States Patent
Strong

(10) Patent No.: US 8,926,392 B2
(45) Date of Patent: Jan. 6, 2015

(54) CONTAINER WITH MOVEABLE ELEMENT

(71) Applicant: Finn Alexander Strong, San Rafael, CA (US)

(72) Inventor: Finn Alexander Strong, San Rafael, CA (US)

( * ) Notice: Subject to any disclaimer, the term of this patent is extended or adjusted under 35 U.S.C. 154(b) by 155 days.

(21) Appl. No.: 13/860,516

(22) Filed: Apr. 10, 2013

(65) Prior Publication Data

US 2013/0228479 A1 Sep. 5, 2013

Related U.S. Application Data

(63) Continuation-in-part of application No. 13/588,035, filed on Aug. 17, 2012, now Pat. No. 8,752,308, which is a continuation of application No. 13/333,462, filed on Dec. 21, 2011, now Pat. No. 8,266,828, application No. 13/860,516, which is a continuation-in-part of application No. 13/772,316, filed on Feb. 20, 2013, now Pat. No. 8,505,116, which is a continuation-in-part of application No. 13/588,035, filed on Aug. 17, 2012, now Pat. No. 8,752,308.

(60) Provisional application No. 61/429,177, filed on Jan. 2, 2011, provisional application No. 61/528,100, filed on Aug. 26, 2011.

(51) Int. Cl.

| | |
|---|---|
| ***A63H 33/00*** | (2006.01) |
| ***B65D 25/28*** | (2006.01) |
| ***F15B 15/10*** | (2006.01) |
| ***A45C 13/28*** | (2006.01) |
| ***A45C 15/00*** | (2006.01) |
| *A63H 3/52* | (2006.01) |

(52) U.S. Cl.

CPC ..... *B65D 25/28* (2013.01); *F15B 15/10* (2013.01); *A45C 13/28* (2013.01); *A45C 15/00* (2013.01); *A45C 2200/00* (2013.01)

USPC ..... 446/75; 446/197; 446/221

(58) Field of Classification Search

USPC ..... 446/71–77, 176, 180, 183, 197, 198, 446/220, 221, 223, 226

See application file for complete search history.

(56) References Cited

U.S. PATENT DOCUMENTS

| | | | |
|---|---|---|---|
| 1,560,073 | A | 11/1925 | Bontempi et al. |
| 2,673,349 | A | 3/1954 | Key |
| 2,721,420 | A | 10/1955 | Chatten |
| 2,803,015 | A | 8/1957 | Milone |
| 3,047,879 | A | 8/1962 | Spreiregen |
| 3,125,827 | A | 3/1964 | Ostrander |
| 3,141,261 | A | 7/1964 | Mirando |
| 3,186,126 | A | 6/1965 | Ostrander |
| 3,237,344 | A | 3/1966 | Ostrander |
| 3,340,846 | A | 9/1967 | Magiera |
| 3,451,160 | A | 6/1969 | Ryan et al. |
| 3,501,144 | A | 3/1970 | Schmidt |
| 3,738,024 | A | 6/1973 | Matsuda |
| 3,740,893 | A | 6/1973 | Shinoda |
| 3,882,631 | A | 5/1975 | Goldfarb et al. |
| 4,009,528 | A | 3/1977 | Villari, Jr. et al. |
| 4,057,928 | A | 11/1977 | Terzian |

(Continued)

*Primary Examiner* — Kien Nguyen

(74) *Attorney, Agent, or Firm* — Patent Law Offices of Michael E. Woods; Michael E. Woods

(57) ABSTRACT

A system and method for increasing customer interest in containers. A set of actuating components are coupled to moveable elements of an active container, the moveable elements respond to operation of an actuating mechanism in a handle portion.

22 Claims, 6 Drawing Sheets

(56) References Cited

U.S. PATENT DOCUMENTS

| | | | | |
|---|---|---|---|---|
| 4,067,138 | A | 1/1978 | Cederholm et al. | |
| 4,124,952 | A | 11/1978 | Terzian | |
| 4,217,725 | A | 8/1980 | Sapkus et al. | |
| 4,218,780 | A | 8/1980 | Growe et al. | |
| 4,287,681 | A | 9/1981 | Albert et al. | |
| 4,324,005 | A | 4/1982 | Willis | |
| 4,669,997 | A | 6/1987 | Kulesza et al. | |
| 4,759,737 | A | 7/1988 | Ferenczi | |
| 4,828,526 | A | 5/1989 | Schneider et al. | |
| 4,845,865 | A | 7/1989 | Chang et al. | |
| 5,046,980 | A * | 9/1991 | Tai et al. | 446/73 |
| 5,129,106 | A | 7/1992 | Liou | |
| 5,243,707 | A | 9/1993 | Bodinet | |
| 5,259,070 | A | 11/1993 | De Roza | |
| 5,285,585 | A | 2/1994 | Baker | |
| 5,325,539 | A | 7/1994 | Kronenberger | |
| 5,564,201 | A | 10/1996 | O'Connell | |
| 6,094,742 | A | 8/2000 | Gattamorta | |
| 6,389,604 | B1 | 5/2002 | Day | |
| 6,439,950 | B1 | 8/2002 | Goldman et al. | |
| 6,672,932 | B1 | 1/2004 | Panec et al. | |
| 6,681,504 | B2 | 1/2004 | Kinan | |
| 6,881,119 | B2 | 4/2005 | Panec et al. | |
| 7,451,555 | B1 | 11/2008 | Lakic | |
| 7,892,064 | B2 * | 2/2011 | Carruth | 446/73 |
| 8,266,828 | B2 | 9/2012 | Strong | |
| 2010/0219221 | A1 * | 9/2010 | Zheng | 224/576 |

* cited by examiner

CONTAINER WITH MOVEABLE ELEMENT

CROSS REFERENCE TO RELATED APPLICATIONS

This application is a continuation-in-part of U.S. patent application Ser. No. 13/588,035 and a continuation-in-part of U.S. patent application Ser. No. 13/772,316, both of which are a continuation of U.S. patent application Ser. No. 13/333,462, now U.S. Pat. No. 8,266,828, which claims benefit of both U.S. Provisional Application No. 61/429,177, filed 2 Jan. 2011, and U.S. Provisional Application No. 61/528,100, filed 26 Aug. 2011, the contents of these applications in their entireties are expressly incorporated by reference thereto for all purposes.

FIELD OF THE INVENTION

The present invention relates generally to portable containers, and more specifically, but not exclusively, to baskets having user-controlled moveable elements.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

There are many types of baskets and portable containers that are used to collect and carry a variety of objects. Retailers continue to search for changes in containers to increase customer interest.

What is needed is a system and method for increasing customer interest in portable containers.

BRIEF SUMMARY OF THE INVENTION

Disclosed is a system and method for increasing customer interest in portable containers. The following summary of the invention is provided to facilitate an understanding of some of technical features related to active portable containers with one or more moveable element, and is not intended to be a full description of the present invention. A full appreciation of the various aspects of the invention can be gained by taking the entire specification, claims, drawings, and abstract as a whole. The present invention is applicable to other styles of portable containers besides baskets and to other types and methodologies of actuating mechanisms.

An active container, including a container portion including one or more walls defining a cavity accessible through an opening; a handle portion coupled to the one or more walls configured to support the container portion while being carried; and an actuator assembly, including: a first actuating mechanism coupled to the handle portion, the first actuating mechanism having a bulb defining a first actuating volume containing a first quantity of air, the bulb repeatably collapsible to expel a portion of the first quantity of air through a first actuating port of the bulb, the bulb automatically expanding to refill the first actuating volume; a first remote actuator having a pair of flexible layers forming a non-deformable actuating balloon defining a second actuating volume accessible through a second actuating port, the first remote actuator having a fixed portion foldably coupled to a moving portion at a fold region with the moving portion at least partially overlapping the fixed portion defining a folded configuration, the fixed portion coupled to the one or more walls of the container portion with the fold region and the moving portion both disposed outside of the cavity, the first remote actuator unfolding about the fold region from the folded configuration in response to air entering into the second actuating volume with the moving portion moving away from the fixed portion and the first remote actuator folding about the fold region in response to air exiting from the second actuating volume, the first remote actuator biased to the folded configuration; and an air communication channel coupled to the first actuating port of the first actuating mechanism and to the second actuating port of the first remote actuator.

An active container, including a container portion having a rigid inner shell defining a container cavity accessible through an opening, the rigid inner shell covered by an outside layer; and an actuator assembly, including: a first actuating mechanism having a collapsible structure defining a first actuating volume containing a first quantity of air, the collapsible structure repeatably collapsible to expel a portion of the first quantity of air through a first actuating port of the collapsible structure, the collapsible structure automatically expanding to refill the first actuating volume; a first remote actuator having a pair of flexible layers forming an actuating balloon defining a second actuating volume accessible through a second actuating port configured to repeatably inflate and deflate the actuating balloon, the first remote actuator having a first portion coupled to a second portion defining an unactuated configuration when the actuating balloon is deflated and defining an actuated configuration when the actuating balloon is inflated, the first portion fixed to the rigid shell with the second portion disposed outside of the container portion, the first remote actuator transitioning from the unactuated configuration to the actuated configuration in response to air entering into the second actuating volume and the first remote actuator transitioning from the actuated configuration to the unactuated configuration in response to air exiting from the second actuating volume, the first remote actuator biased to the unactuated configuration; and an air communication channel coupled to the first actuating port of the first actuating mechanism and to the second actuating port of the first remote actuator.

A method for operating an active container, including a) carrying a container portion using a handle portion coupled to the container portion, the container portion including one or more walls defining a cavity accessible through an opening; b) collapsing a collapsible structure coupled to the handle portion while carrying the container portion to expel a quantity of air from a first actuating volume of the collapsible structure through a first actuating port; c) communicating an increased air pressure, responsive to the quantity of air expelled from the first actuating volume, to a remote actuator coupled to the container portion, the remote actuator having a pair of flexible layers forming a non-deformable actuating balloon defining a second actuating volume accessible through a second actuating port, the remote actuator having a fixed portion foldably coupled to a moving portion at a fold region with the moving portion at least partially overlapping the fixed portion defining a folded configuration, the fixed portion fixed to the one or more walls with the fold region and the moving portion both disposed outside of the container portion, the remote actuator unfolding about the fold region from the folded configuration in response to air entering into the second actuating volume responsive to the increased air pressure with the moving portion moving away from the fixed portion and the first remote actuator folding about the fold region in response to air exiting from the second actuating volume, the remote actuator biased to the folded configuration; d) moving, responsive to the increased air pressure, a sheath to an operated configuration, the sheath coupled to an outside surface of the one or more walls wherein the sheath conceals the fold region and the moving portion of the remote actuator extending outside the container portion with the sheath coupled to the moving portion and having the operated configuration when the remote actuator is unfolded; and e) moving the sheath to an unoperated configuration irrespective of whether the collapsible structure is released by transitioning the remote actuator to the folded configuration by an exiting of air from the second actuating volume, the sheath having the unoperated configuration when the remote actuator is folded wherein the exiting of air includes an exit through a bleed mechanism communicated to the second actuating volume and may additionally include an exit of air by releasing the collapsible structure allowing the collapsible structure to automatically expand and refill the first actuating volume.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 4 illustrates the valve allowing air into an air reservoir;

FIG. 5 illustrates the valve with the bleed mechanism bleeding air from the air reservoir;

DETAILED DESCRIPTION OF THE INVENTION

Embodiments of the present invention provide a system and method for increasing customer interest in portable containers. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

U.S. Pat. No. 8,266,828 for Footwear Having Air-controlled Active Elements describes a clothing article for a foot in which active elements associated with the clothing article were automatically activated as the user walked. This patent is hereby expressly incorporated by reference thereto in its entirety for all purposes.

In the following discussion and in the figures, a modification to a particular style of portable container is shown, however it is understood that the present invention may be adapted to other styles of containers. A Halloween basket is a thematic portable container for children and young adults for use during Halloween activities, though the portable containers of the present invention are not limited to such uses. The Halloween basket includes a container portion having a container cavity for storing objects and a handle portion secured to the container portion. One or more of these portions may include static animal, fanciful creature, or "monster" features and a thematic likeness of the depicted animal, creature, or monster. Sometimes there is a lid or covering, and moveable elements added to provide a representation of a limb, or other body part of the depicted animal, creature, or monster. Embodiments of the present invention include structures and methods that animate one or more features of such a portable container under a user's control.

Figure 1:
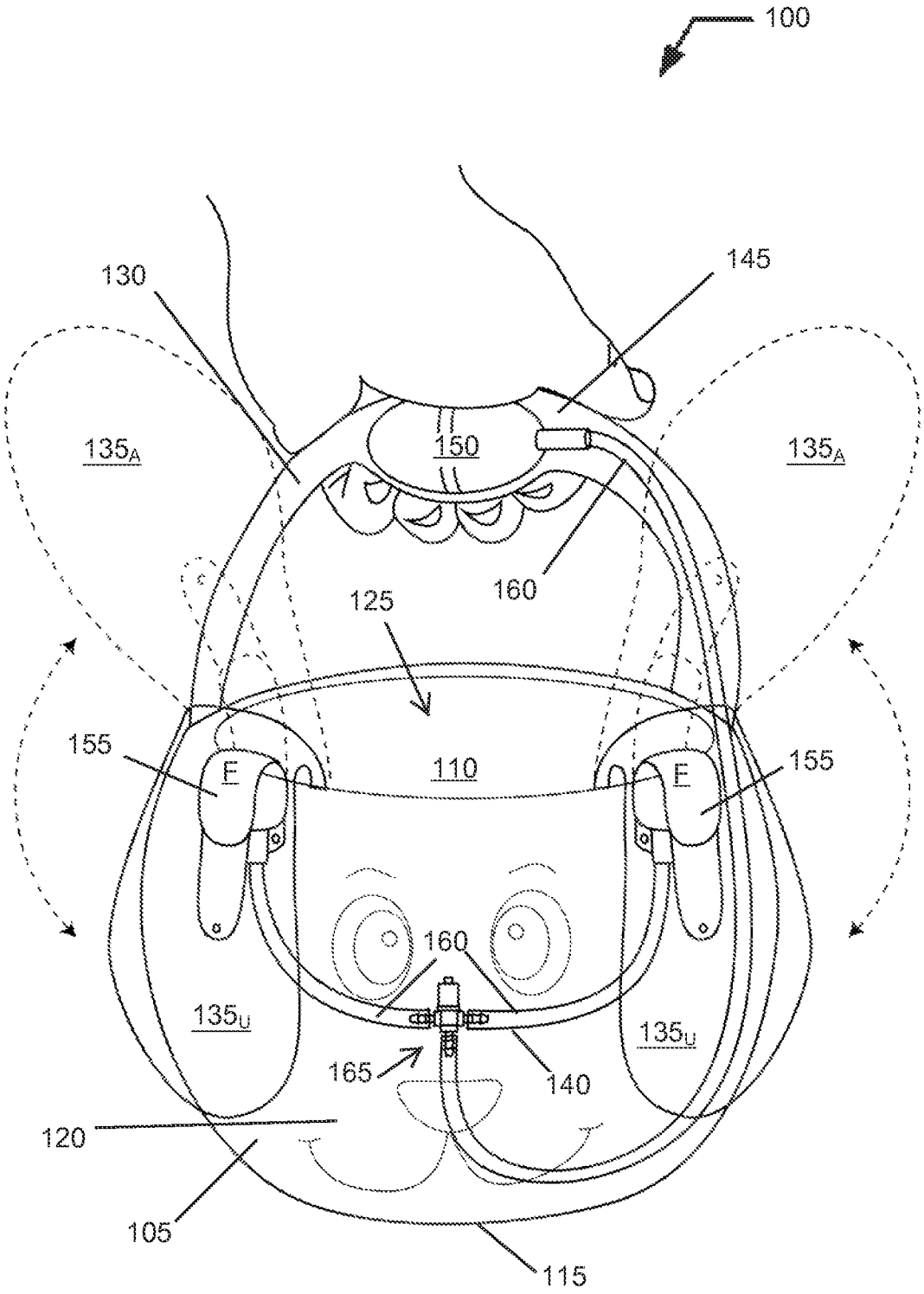
FIG. 1 illustrates a front isometric view of an active container having one or more moveable elements arranged into a thematic configuration.

FIG. 1 illustrates a front isometric view of an active container 100 having one or more moveable elements arranged into a thematic configuration, in this case, a puppy. Active container 100 includes a container portion 105 that is designed to define a holding volume 110 defined by a bottom wall 115 and one or more sidewalls 120. An opening 125, often disposed at a top of container portion 105 allows access into holding volume 110. Active container 100 includes a handle portion 130 coupled to opposing portions of the top of container portion 105. Active container 100 includes one or more moveable elements 135, for example puppy ears, that are responsive to operation of an actuator assembly 140.

Container portion 105 may be of unitary construction or may include an assembly of flexible, semi-rigid/flexible, and/or rigid components. For example, in some implementations a rigid shell may be formed and an exterior covering or overwrap applied to conceal the shell. In other implementations, an inner layer and an outer layer may be combined. In both cases there are one or more spaces between an innermost component and an outermost component that is available to conceal actuator assembly 140.

Container portion 105 is preferably constructed having at least two layers, an inside shell and an outside layer. The material may be natural or synthetic fabric, leather, polymer, elastomer, or the like, of virtually any type with the disclosed embodiments including one or more outer/visible components being of plush construction. Plush, in this context refers to natural (e.g., mohair, worsted yarn, silk) or synthetic (e.g., polyester) fibers and may include a filler or "stuffing" between the inside shell and the outside layer. In some implementations, the outer layer does not completely cover the inside shell of container portion 105 leaving some part(s) uncovered. Other implementations may dispense with the outside layer completely. Such implementations may not conceal some or all of the actuating components, or the actuating components may be integrated or concealed in some other fashion, such as integrating air channels inside the inner shell.

As described herein, active container 100 includes one or more user-controlled moveable elements 135. There is a wide range of different configurations, sizes, and weights associated with moveable elements 135. Moveable elements 135 are manually controlled by operation of actuator assembly 140. Components of actuator assembly 140 are distributed. Actuator assembly 140 includes Handle portion 130 of the disclosed embodiments include a multilayer construction to form an inner channel and may be constructed of the same material as used in the outer layer of container portion 105. In the preferred embodiments a thematic configuration is often set for active container 100, such as a particular animal, fanciful creature, monster, or the like. Moveable elements 135 are configured to further support and extend the theme, such as by providing moving limbs and the like. Handle portion 130 may also extend the theme by also providing theme-specific visualizations and arrangements. A middle part 145 of handle portion 130 includes a larger space or gap.

In the disclosed embodiments, middle part 145 has a greater lateral width than handle portion 130 because it hides an actuating mechanism used to manipulate the one or more moveable elements 135. The disclosed embodiments include one or more moveable elements and one or more actuating mechanisms hidden in handle portion 130. Some implementations provide that two moveable elements may be independently controlled by two actuating mechanisms while other implementations include the two moveable elements controlled concurrently by the same single actuating mechanism. This principle may be extended to more than two moveable elements with a first set controlled by a first actuating mechanism and a second set controlled by a second actuating mechanism. The disclosed embodiments provide for a maximum of two actuating mechanisms in middle part 145, one directed toward each lateral side of container portion 105.

Handle portion 130 is not limited to a rigid or semi-rigid "arch" over a top opening of container portion 105. The opening in container portion 105 may include openings other than a top opening, including a side or oblique (partially top and partially side) opening and handle portion 130 may have virtually any relationship to the opening and/or container portion 105. For example, handle portion 130 may extend from a side like a coffee mug and include a concealed or integrated actuating mechanism. Handle portion 130 may include or consist of soft flexible strap portions. Handle portion 130 may support, conceal, or form all or a portion of the actuating mechanism and/or a portion of the conduit. Handle portion 130 may include a structure defining a hollow tube or channel further defining a suitably flexible region to allow actuation of the actuating mechanism(s), whether a single layer or multilayer construction or assembly.

Moveable elements 135 are external thematic elements that respond to the actuating mechanisms to tilt, lift, unfold, expand, extend, rotate, flap, open, or otherwise move to a first configuration when one or more actuating mechanisms are operated. Moveable elements 135 are biased to an untilted, dropped, folded, contracted, withdrawn, unrotated, closed, or otherwise motionless second configuration. Manual operation of actuating mechanism in handle portion 130 overcomes the bias to transition an effected moveable element from the second configuration to the first configuration. As further explained herein, moveable element 135, being biased to the second configuration, automatically transitions from the first configuration to the second configuration after a period.

Moveable elements 135 contain concealed actuators that are covered by material (e.g., cloth, plush, other fabric, plastic, rubber , and the like) that may be opaque, translucent, transparent or a combination of these properties. Some moveable elements 135 include a first portion that is visible in both the first configuration and in the second configuration and a second portion only visible in the first configuration. For example, in FIG. 1, active container 100 includes a puppy theme and moveable elements 135 are shown in the second configuration as unactuated puppy ears $\mathbf{135}_U$. When actuated, moveable elements 135 are lifted to the first configuration including an actuated set of puppy ears $\mathbf{135}_A$. Actuated set of puppy ears include an outside ear portion as the first portion and an inside ear portion as the second portion. As shown, in the first configuration, the outside ear portion is visible in both the first configuration and in the second configuration. The inside ear portion is visible in the first configuration only.

Moveable elements 135 of FIG. 1 are configured to lift laterally, but are not required to do so. A relative motion between moveable element 135 and container portion 105 is determined by the type of internal actuator included within moveable element 135 and the arrangement and specifics of an attachment configuration of moveable element to container portion 105, including any hinging coupling that physically connects moveable element 135 to container portion 105. Some moveable elements 135 may move laterally, frontally, rearwardly, side-to-side, bottom-to-top, diagonally, or a combination thereof. In some instances, the concealed actuator within moveable element 135 may have a complex motion.

FIG. 1 also illustrates a schematic view of actuator assembly 140. Actuator assembly 140 is typically concealed within the multilayers of active container 100. To facilitate visualization of the components of active container 100, actuator assembly 140 is illustrated in solid lines though they are, in the embodiment of FIG. 1, hidden from external view. This arrangement is only representative as there are many different component organizations that are possible to achieve the purpose and effect demonstrated by the depicted arrangement. The arrangement illustrated in FIG. 1 provides a type of single actuating mechanism controlling concurrently multiple moveable elements 135.

Actuator assembly 140 includes an actuating mechanism 150, one or more remote actuators 155, a conduit 160 communicating air from actuating mechanism 150 to the one or more remote actuators 155, and an intake valve assembly 165 disposed in conduit 160. In the disclosed embodiment, actuator assembly 140 may be formed as a discrete separate assembly that may be installed (e.g., cut and sewn) into active container 100. In other implementations, actuator assembly 140 may be independent elements separately installed and assembled into active container 100.

The incorporated patent application includes a discussion of actuating components used in footwear. Actuator assembly 140 is adapted from those components to meet the special needs and requirements of the present invention. When adapting the footwear actuating components in the headwear context, there is no easy way to implement automatic actuation as was done in the footwear example which had the actuating mechanism disposed within the sole. Each step resulted in operation of the actuating mechanism which triggered moveable elements affixed to an upper of the footwear. Being disposed within a sole of child's shoe or the like imposed a number of design constraints including a relatively low capacity actuating mechanism and concerns regarding overpressure. The low capacity actuating mechanism required efficient small sized remote actuators and the potential overpressure results in sturdier construction and structures referred to as bleed valves. In the disclosed embodiments, the system is configured for some robustness as it allows for unintended perforations or injury to the air channels and actuating volumes to function as secondary bleed mechanisms. Thus the illustrated systems are considered open, lossy, and the like as opposed to sealed/closed systems.

Similar design constraints include efficient manufacturability and low cost of goods. Simple and non-complex is preferred over complicated and complex structures, assemblies, and arrangements. The disclosed embodiments detail a specific combination of actuating components that provides efficient repeatable motion to the moveable elements at a cost that results in a price point supported by the market for active containers.

Actuating mechanism 150 is similar in construction and operation to the corresponding structure in the incorporated applications. That is, actuating mechanism 150 includes a resilient bulb or bellows that contains an actuating air volume. The bulb is repeatably collapsible to expel a portion of the actuating air volume through an actuating port with each actuation. The bulb is configured to be collapsed by the user squeezing the bulb with a hand. Releasing the bulb allows the bulb to automatically expand and refill the actuating air volume with air. The air is refilled with ambient air, such as through a one-way valve disposed within the bulb and/or through intake valve assembly 165. When implemented for children, the bulb is made very pliable to be easily squeezed and operated by a young child.

One risk associated with the footwear implementation that is reduced in the embodiments described herein is that of rupture. An active footwear article that is operated by a bellows disposed in the sole is subject to potentially large impulses that can create significant overpressure stresses on the actuating assembly. These impulses may be easily produced, such as by jumping and landing on the soles of the footwear. Actuator assembly 140 is not as much at risk because it is more challenging for a user to generate similar impulses by squeezing the bulb.

Preferably the bulb is made from a blown plastic configured to contain a sufficient quantity of air to operate remote actuators 155, while being sufficiently pliable and robust to be repeatably squeezed and released without degradation of actuating mechanism's ability to expel the portion of air each time it is squeezed and refill when released.

Remote actuator 155 may be implemented in many different ways. The incorporated patent applications detail several different styles and types of remote actuators, any of which may be adapted for remote actuator 155. The disclosed embodiments include remote actuator 155 that includes an elongate resilient outer shell that contains an actuating volume accessed through an actuating port. Remote actuator 155 is controlled (e.g., unfolding and folding) by air entering into and leaving the actuating volume.

Remote actuator 155 includes a folded configuration in which one portion overlies another portion when the actuating volume has little if any air, the amount of folding is greatest with the least amount of air within the actuating volume. Air entering into the actuating volume causes remote actuator 155 to unfold and straighten. A quantity of air entering into the actuating volume controls the degree and extent of the unfolding. Remote actuator 155 is unfolded to the greatest degree when the actuating volume contains the greatest quantity of air. In some implementations, remote actuator 155 may be fully unfolded when fully actuated. The actuating air volume of actuating mechanism 150 is sized to achieve the desired degree of unfolding of remote actuator 155, it being understood that some embodiments do not desire or require that remote actuator 155 fully unfold.

Remote actuator 155 is biased towards the fully folded configuration. Air entering into the actuating volume is calibrated to cause remote actuator 155 to unfold against the biasing force. Periodically the air pressure at the actuating port will drop below that which is sufficient to overcome the biasing force and remote actuator will then automatically fold and dispel all or a portion of air from the actuating volume to enable it to fold. The degree of folding is at least partially influenced by the air pressure at the actuating port resisting the dispelling of the air from the actuating volume.

In some embodiments, as noted above and as described in the incorporated patent applications, it may be desirable or required to include an optional bleed valve or the like in the actuating volume. For example, the bleed valve may be included at an extreme distal end when the proximal end includes the actuating port and a fold region F is intermediate the two ends. In this configuration, air entering into the actuating volume first unfolds remote actuator and as long as a rate of air entering into the actuating volume is greater than a rate of air exiting the bleed valve, remote actuator will continue to unfold. When air stops entering into the actuating volume, the air exiting the bleed valve will then allow remote actuator to automatically fold in response to the biasing forces.

Figure 2:
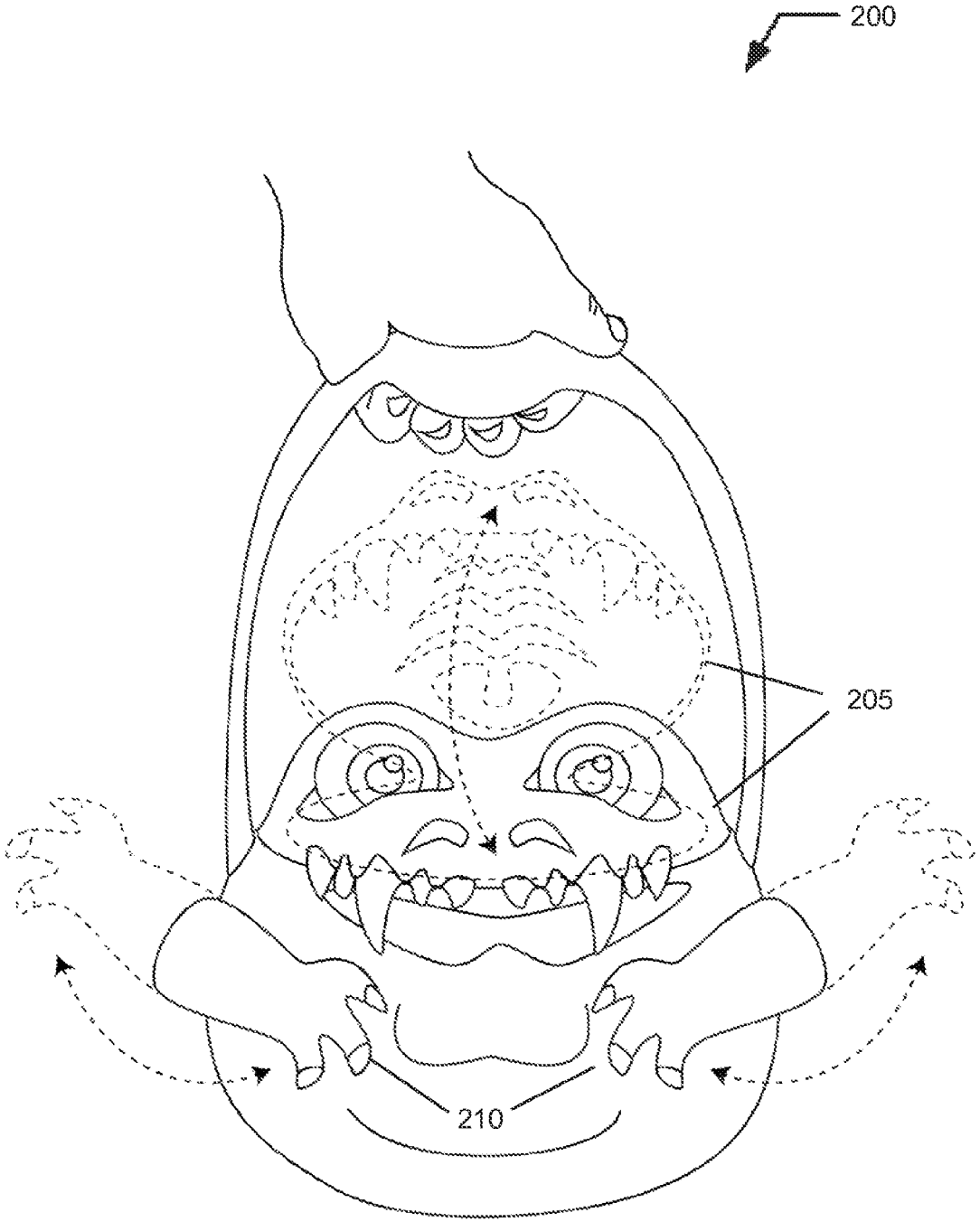
FIG. 2; illustrates a front isometric view of an alternate active container having one or more moveable elements arranged into a thematic configuration.

As noted in the incorporated patent applications, there are several different ways of providing the biasing force to remote actuator 155. A biasing mechanism provides the biasing force and may include a memory plastic that "memorizes" a desired folded shape, a metal spring with a restorative spring constant, a memory alloy with a preconfigured shape, or the like is preformed into a biasing configuration to position remote actuator into the folded configuration and attached to or integrated with remote actuator 155. Unfolding remote actuator 155 operates against the biasing mechanism which will begin to automatically fold remote actuator 155 once the air pressure within the actuating volume drops low enough. As illustrated in the embodiments of FIG. 1-FIG. 2, the biasing force may be supplemented by gravity to help fold/close the remote actuators.

An outer shell of remote actuator 155 is formed from a memory plastic that may be set (e.g., thermoset) into a biasing configuration. For example, remote actuator 155 includes a blow-molded shell of "memory" plastic having the internal cavity. The shell is initially formed into the unfolded configuration and then the shell is folded/bent into the folded configuration and then set so that the folded configuration is memorized. Thereafter, air entering into the folded shell will unfold it. Once the air pressure falls, the biasing forces from the outer shell will re-fold the actuator and will be ready for re-actuation. The cycle of unfolding and folding is repeatable. One advantage of this construction is that the outer shell forming the actuating volume may be made thin and pliable while a portion forming the actuating port may be more rigid and suitable for forming a conduit connector integrated into the manufacturing process and reducing costs of assembly.

In the footwear, in some embodiments it was important for responsiveness that a remote actuator automatically deflate after a period even when a user did not unweight the sole in preparation for another air-expelling weighting of the sole. In the present invention, because the remote actuators are manually operated, it is an implementation option to reproduce this behavior (e.g., to deactuate remote actuators 155 while actuating mechanism 150 remains actuated) or to maintain remote actuator 155 in the actuated configuration as long as the actuating mechanism remains actuated).

Conduit 160 includes air tubes and the like that are able to communicate air from actuating mechanism 150 to one or more remote actuators 155. In the disclosed embodiments, conduit 160 is non-expandable at the air pressures employed to actuate remote actuators 155. Thus in this context, conduit 160 is non-expandable. In the illustrated embodiments, conduit 160 includes an actuating mechanism end and one or more remote actuator ends. The actuating mechanism end is coupled to actuating mechanism 150 and the remote actuator ends are coupled to the actuating ports of remote actuator 155.

There are several different arrangements included in the illustrated embodiments. Illustrated in FIG. 1 is an arrangement in which a single actuating mechanism 150 operates a pair of remote actuators 155. One way this is accomplished is by use of intake valve assembly 165 also serving as a conduit multiplier (e.g., a "three-way" connector) that splits a single channel of conduit 160 into two or more channels. Other arrangements include a pair of actuating mechanisms operating either one or a pair of remote actuators. And as noted, the present invention includes implementations having more than two actuating mechanisms and/or more than two remote actuators.

For a pair of actuating mechanisms and pair of remote actuators, it is possible that the remote actuators are controlled independently from each other or controlled concurrently with each other. In an independent implementation, two conduits 160 are used, one conduit 160 extending from one actuating mechanism to the remote actuator it controls. In operation, one actuating mechanism controls one remote actuator and the other actuating mechanism controls the other remote actuator. In a concurrent implementation, a four-way conduit multiplier is used to co-join the two channels from the actuating mechanisms to the two channels from the remote actuators. In operation, either actuating mechanism actuates both remote actuators at the same time; an ambidextrous arrangement.

Intake valve assembly 165 is disclosed in the parent applications as a special three-way connector. It is special in that two-way airflow is unobstructed between a first port and a second port while airflow is one-way from a third port to the first port and the second port. In other words, when coupling the third port of intake valve assembly 165 to ambient, air may flow from ambient to the first port and/or the second port but air will not flow out to ambient from the third port. The first port and the second port are coupled to conduit 160 so that two-way air flow exists in the channel from an actuating mechanism to the one or more remote actuators.

In FIG. 1, intake valve assembly 165 is shown located remotely from actuating mechanism 150. The actuating port of actuating mechanism 150 is coupled to the first port of intake valve assembly 165 by conduit 160 and the second port of intake valve assembly 165 is coupled to another portion of conduit 160. The preferred embodiments also use a softer material in the construction of remote actuators because they may be made to be more easily actuated for operation by children.

In FIG. 1, remote actuators 155 are configured so that an outside portion is disposed outside the outer layer of container portion 105 and an inside portion is disposed between the multilayers of container portion 105. An aperture is made in the outer layer of container portion 105 and the distal end of remote actuator 155 is passed through. Fold portion is located at the aperture but slightly outside the outer layer of container portion 105. A sheath is made for remote actuator 155 and attached to container portion 105 at the aperture to completely hide remote actuator 155. As discussed herein, the sheath includes two portions, a first portion and a second portion, in the sense of visibility based upon a state of remote actuator. The sheath is preferably designed so that the first portion and the second portion are differently designed, providing some contrast, and attendant surprise and increased interest, when the second portion is selectively revealed upon actuation. These portions of the sheath correspond in some implementations to the outside ear portion and the inside ear portion.

When operating an actuating mechanism 150, air dispelled from the actuating air volume through the actuating port increases an air pressure of air within conduit 160 and increases the air pressure at the actuating ports of the remote actuators 155 that are coupled to the operated actuating mechanism 150. When the air pressure at the actuating port of the remote actuator(s) 155 is great enough to overcome the biasing force, air enters into the actuating volume and unfolds it against the biasing force. To an observer of the puppy themed active container 100, squeezing middle part 145 corresponding to the operated actuating mechanism 150, both of the puppy ears lift and reveal the inside ear portions. When the user stops squeezing the middle part 145, actuating mechanism 150 is released and the bulb is refilled with air from ambient, conduit 160, and from the actuating volume of remote actuator 155 corresponding to the actuated puppy ears. Consequently the puppy ears fall until only the outside ear portions are visible. For a dual arrangement of actuating mechanisms, it would be possible to independently control the ears such that squeezing a left-hand side portion raises a left-hand side puppy ear only and squeezing a right-hand side portion raises a right-hand side puppy ear only.

Of importance is anchoring in the attachment points where conduit 160 engages the actuating ports of remote actuators 155. Without proper definition of these anchors, remote actuators 155 may shift or bind within the sheath/outside layer portion and interfere with unfolding and folding. It is preferred that the fold region F be located outside the outer layer of container portion 105 to reduce any binding/unfolding limitation.

Further, the attachment of a proximal end remote actuator 155 (e.g., the end of remote actuator with the actuating port) inside of the outside layer helps define the relative motion of remote actuator 155 and container portion 105. Without proper anchoring and without proper orientation, a remote actuator that is intended to move moveable elements in a first direction (up/down laterally) may fail to move them or may move them up/down towards the front of the container which may not match the intended theme and thus be unacceptable to the wearer. In the case of an implementation including a rigid inner shell, is it beneficial to mount an inside portion of remote actuator 155 to the shell to resist shifting and errors in actuation.

FIG. 2; illustrates a front isometric view of an alternate active container 200 having one or more moveable elements arranged into a thematic configuration, in this case, a "monster." Except as noted herein, the arrangement and operation of alternate active container 200 corresponds to the arrangement and operation of active container 100.

Alternate active container 200 includes a lid 205 configured to conceal and cover holding volume 110. Lid 205 participates in the thematic configuration by appearing as a first moveable element arranged as a head/jaw of the monster. Instead of puppy ears, alternate active container 200 may include arms and claws as second moveable elements 210 that extend and fold. Lid 205 and second moveable elements 210 are operated by the actuator assembly disposed therein. When the user operates the actuator assembly, responsive to a set of remote actuators, lid 205 hingedly coupled to a rear wall/portion of the container portion lifts and opens to reveal holding volume 110 and second moveable elements 210 unfold and extend.

Figure 3:
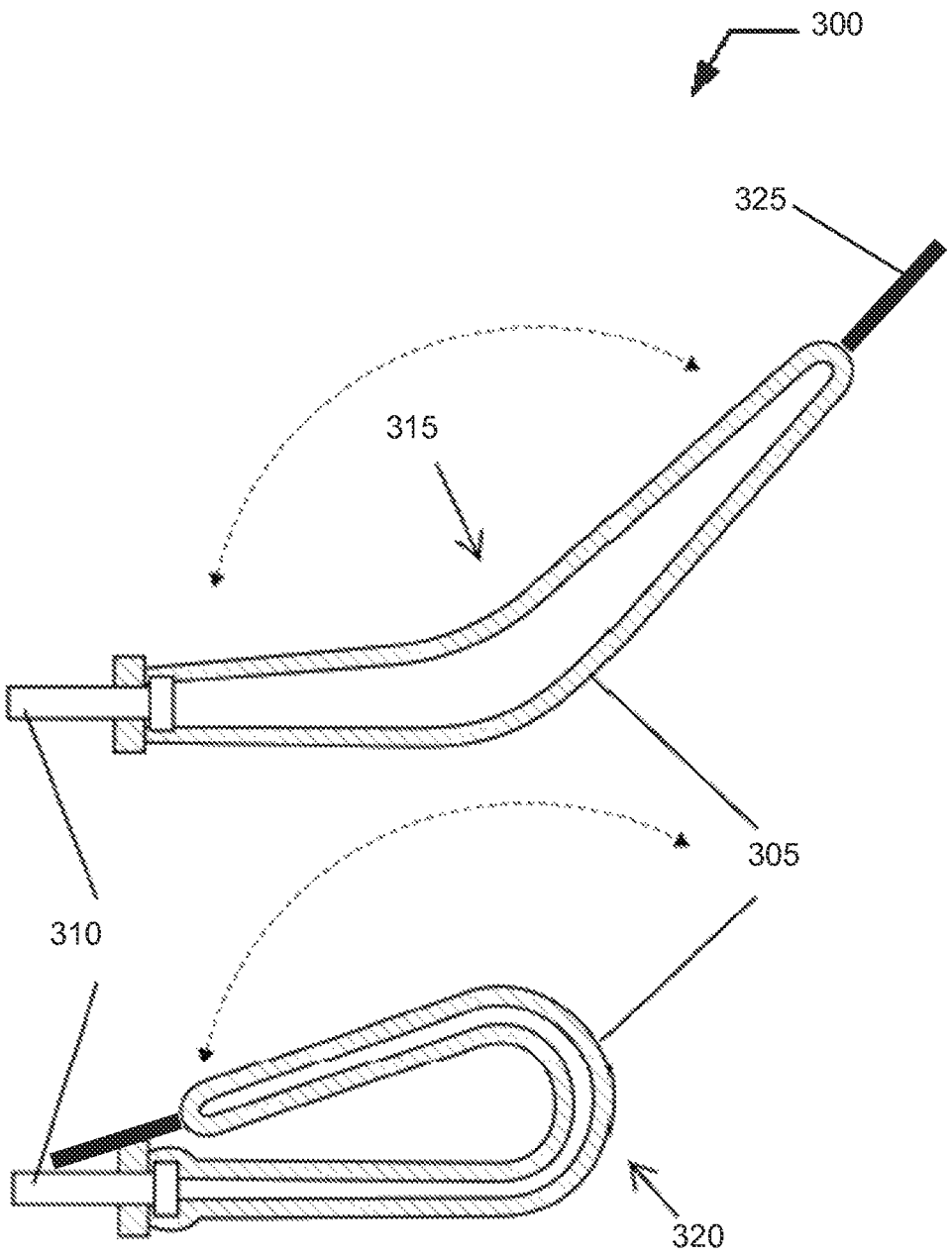
FIG. 3 illustrates a series of side elevation views of an operational sequence for a remote actuator for use with a themed fanciful air-powered active container described herein.

FIG. 3 illustrates a series of side elevation views of an operational sequence for a remote actuator 300 for use with a themed fanciful air-powered active container described herein. Remote actuator 300 may simulate one of a moveable element 135 (e.g., an expanding/contracting limb, appendage, growth, or door, hatch, portal, or the like). Remote actuator 300 includes a folding/unfolding balloon 305 that is soft and mounted to an actuating port 310. Remote actuator 300 opens (e.g., unfolds) when inflated to provide an extended structure 315 and closes (e.g., folds) when deflated to provide a retracted structure 320. Remote actuator 300 includes an optional extension member 325 that is non-inflating hard/rigid portion of balloon 305. In some implementations, dimensions of an active portion of balloon 305 may be relatively short. In order to move longer moveable elements, extension member 325 is used to leverage movement of balloon 305 to better support moveable elements that are longer than the active portion. Extension member 325 includes mounting holes to allow attachment of the sheath of moveable elements 135. In the preferred embodiment, extension member 325 is periodically scored along its length to enable its length to be easily shortened in reproducible predetermined lengths to best match needed lengths.

In some implementations, remote actuator 300 is manufactured of thermoplastic rubber (TPR), blown plastic, and other polymers that may have "memory" properties to be biased into the folded position. One advantage of TPR and other materials in this class is that they include better "memory" and may be stretched and expanded with reduced risk of compromising an integrity of balloon 305. In the case of remote actuators that include elastic, non-deforming expansions, the actuating mechanism may be calibrated to provide a different (e.g., increased) quantity of air as compared to an elastic deformable remote actuator. (For example, a deformable remote actuator would be one that includes an expandable/collapsible balloon that increased capacity as air flows in and decreases capacity as air exits.)

One advantage of remote actuator 300 is that it includes self-biasing features and no additional memory spring or the like is necessary to aid deflation when deactuating. Other embodiments may use variations of remote actuator 300 for actuating one or more of the moveable elements. Further, these elements may be constructed in many different ways. One variation for an inexpensive actuating active element includes a blow-molded bladder in which heat or the like is used to preform the bladder into a "memorized" configuration appropriate for an unactuated mode, similar in visualization to remote actuator 300. Air effects operating on such a bladder straightens it to an actuated mode which will automatically transition to the unactuated mode when the actuating air effect is released.

As illustrated in FIG. 3, remote actuator 300 includes a fixed portion (e.g., a proximal end nearest actuating port 310) attached to the article and a moving portion (e.g., a distal end at an end opposite of the proximal end) moveably coupled to the fixed portion by a fold region. In some implementations, the moving portion includes one or more additional folds to produce an extendable remote actuator, these optional additional folds may be inward or outward folds.

Figure 5:
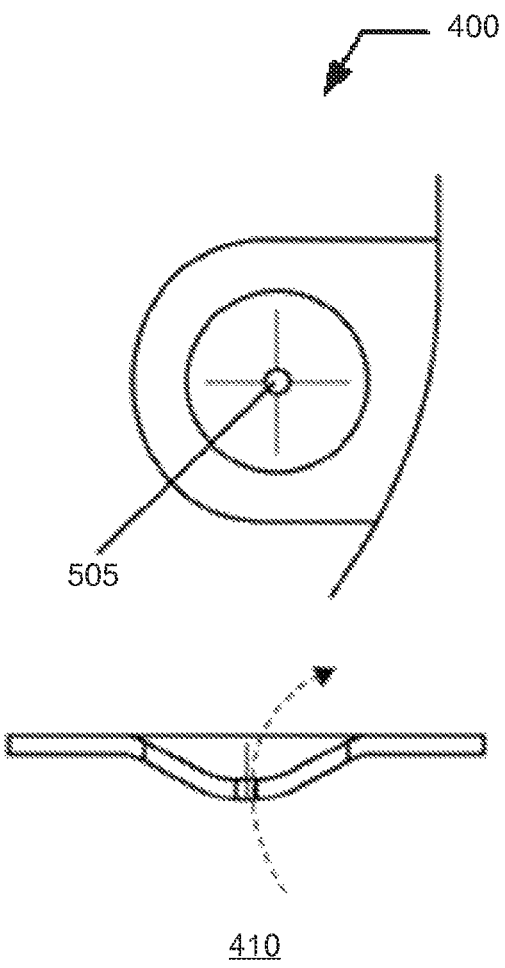
FIG. 4 and FIG. 5 illustrate a modified valve that includes an optional bleed mechanism.
Figure 4:
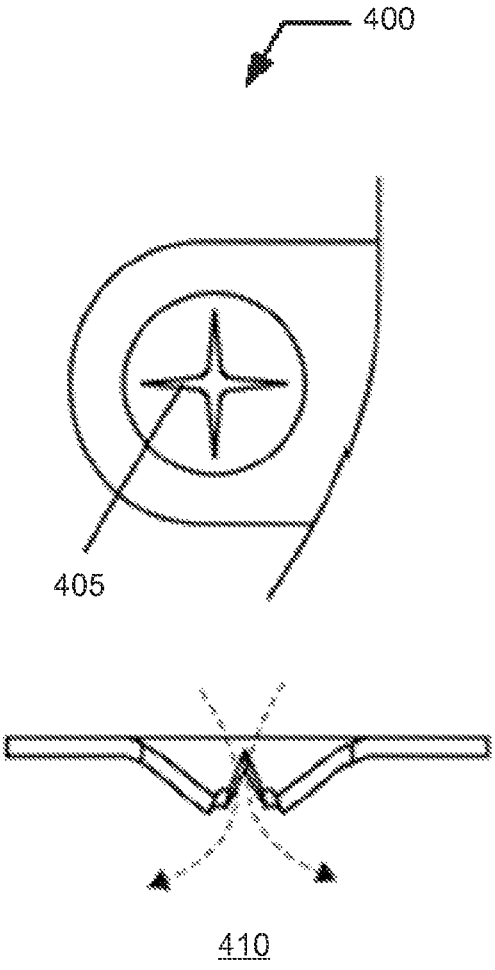

FIG. 4 and FIG. 5 illustrate a modified valve 400 with a valving structure 405 that includes an optional bleed mechanism 505. FIG. 4 illustrates valve 400 open an allowing air into an air reservoir 410 and FIG. 5 illustrates valve 400 closed with optional bleed mechanism 505 bleeding air from air reservoir 410. Air reservoir 410 may include one or more of the actuating mechanism, the remote actuator, and/or the conduit coupling the elements together.

Valve 400 may be a type of one-way valve, allowing quick intake and slow release of air into and out of reservoir 410. Valve 400 is, in a preferred embodiment, a simple cross-cut in a molded air-bladder. An optional small hole provides bleed mechanism 505 coupled with the cross cut (for example placed at a bottom of a concave divot) to provide variable airflow control. Valve 400 in the closed mode includes the optional small hole for slow release. Valve 400 in an open mode has a larger aperture (e.g., open cross-cut) for increased air intake. In some implementations, valve 400 may include a layer of open cell foam or other air-permeable material overlying the cross-cut to help produce a one-way valving effect.

Figure 6:
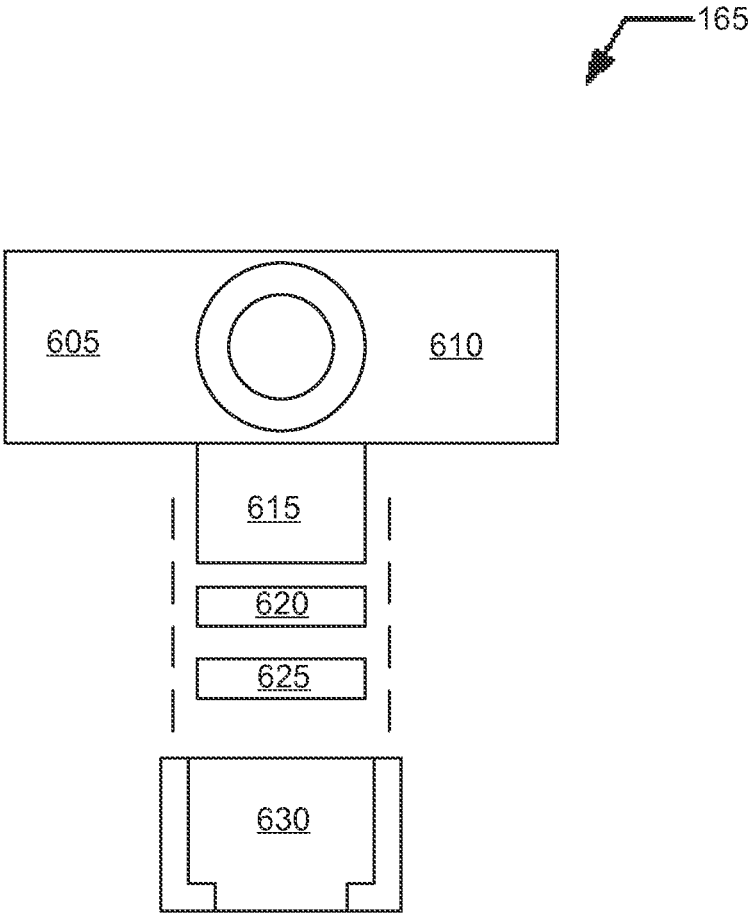
FIG. 6 illustrates an exploded view of the intake valve assembly shown in FIG. 2.

FIG. 6 illustrates an exploded view of intake valve assembly 165 that could be used in FIG. 1 and FIG. 2. Intake valve assembly 165 includes a first port 605, a second port 610, an aperture 615, a fabric layer 620, a rubber diaphragm 625, and a cap 630. Fabric layer 620 permits air leakage/flow through the refill mechanism.

First port 605 may be coupled to actuating mechanism 150 and second port 610 may be coupled to conduit 160 as shown in FIG. 1. Airflow between first port 605 and second port 610 is two-way. Airflow from first port 605 and aperture 615 or second port 610 and aperture 615 is one-way (i.e., from the aperture to either of the ports). In some implementations, such as shown in FIG. 6, the construction of intake valve assembly 165 includes the bleed mechanism as described herein to allow fast intake and slow outflow of air with respect to ambient.

Figure 7:
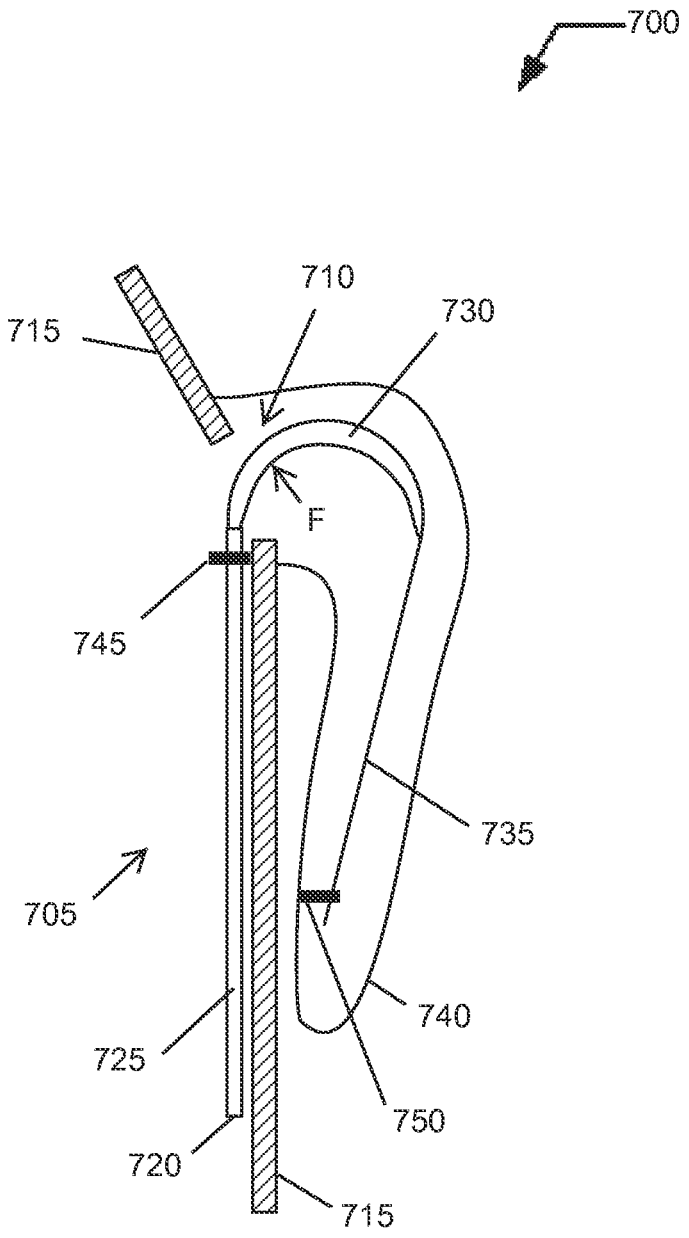
FIG. 7 illustrates a section of the active container where a remote actuator passes through an aperture in the outside layer of the head portion.

FIG. 7 illustrates a section 700 of the active container described herein where a remote actuator 705 passes through an aperture 710 in an outside layer 715 of container portion 105, or over an edge of container portion 105 forming a portion of the opening into holding volume 110. Remote actuator 705 is a variation of remote actuator 300 in terms of arrangement, and except where the following content indicates otherwise, remote 705 conforms to the structural and operational details associated with remote actuator 155 and remote actuator 300 described herein.

Remote actuator 705 includes an actuating port 720, a channel portion 725, an actuating balloon portion 730, and an extension portion 735. A sheath 740 encloses those portions of remote actuator 705 outside of outside layer 715. An actuator anchor attachment 745 (e.g., anchor stitching, staples, tacks, and the like with stitching preferred) secures balloon portion 730 into its desire orientation which is where folding and unfolding (e.g., fold region F) occur primarily and in the illustrated embodiments exclusively outside of outside layer 715.

In this implementation, balloon portion 730 begins at or near anchor attachment 745 and is configured to curve up immediately into and through aperture 710 to maximize folding/unfolding region outside of outside layer 715. This inhibits/resists binding or obstruction of operation of remote actuator 705.

A flapper anchor attachment 750 is preferably positioned, for example by appropriate sizing of extension portion 735, as close to a distal end of sheath 740 as possible without degrading operation. Flapper anchor attachment 750 helps to maintain fold region F in the desired position and resists relative shifting/motion of remote actuator 705 as compared to aperture 710.

The capacities of the air volumes and rates of inflow and bleeding are tuned to achieve the level of responsiveness in actuating the moveable elements. A relative volume of air between the actuating mechanism and the controlled remote actuators, along with a distance between the structures influences a magnitude of motion (e.g., how much unfolding). How quickly the refill assembly is able to refill the actuating mechanism helps influence how quickly the user is able to repeat a motion of a moveable element. It is important that the bleed mechanism not be so large as to interfere with unfolding or so small that the moveable elements are "locked" in the unfolded configuration.

The actuating components have been described in terms of hydraulic systems that employ air. Other systems may employ a fluid for actuation using a closed system lacking bleed mechanisms. In other variations, mechanical linkages and/or levers may be used in place of one or more of the actuating components. For example a lever may operate an air-powered actuating mechanism, or the bellows-type actuating mechanism may trigger a mechanical remote actuator that employs levers and springs to move the moveable elements. In mechanical or hybrid mechanical-hydraulic systems, a moveable flexible cable may couple the actuating mechanism to the remote actuator.

While the embodiments illustrated in the figures include containers with handles overlying the opening, some implementations of the present invention will not include any handles. In such cases, there may be other structures for concealing the actuating mechanism and/or part of the conduit. However, some embodiments may include one or more unconcealed actuating components, whether it be the actuating mechanism, conduit, or remote actuator. For implementations without a handle, some devices may locate the actuating mechanism in or on some other structure, such as an outer wall, a bottom wall, or other container component. The present invention may be embodied in a range of portable container types, for example without limitation, purse, hand bag, shoulder bag, backpack, or the like.

The illustrated embodiments have been described in terms of use of non-deformable balloon actuators which use flexible but inelastic layers to form the actuating balloon. In some implementations, the actuating balloon may be both flexible and elastic forming deformable balloon actuators that "inflate" and "deflate" in response to actuating air. In both cases there is some degree of inflation but the elastic walls of the deformable implementation stretch and grow whereas the walls of the deformable implementation do not stretch. The parent application includes descriptions of these types of actuators which may be employed in the present invention.

The system and methods above have been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An active container, comprising:

a container portion including one or more walls defining a cavity accessible through an opening;

a handle portion coupled to said one or more walls configured to support said container portion while being carried; and an actuator assembly, including:

a first actuating mechanism coupled to said handle portion, said first actuating mechanism having a bulb defining a first actuating volume containing a first quantity of air, said bulb repeatably collapsible to expel a portion of said first quantity of air through a first actuating port of said bulb, said bulb automatically expanding to refill said first actuating volume;

a first remote actuator having a pair of flexible layers forming a non-deformable actuating balloon defining a second actuating volume accessible through a second actuating port, said first remote actuator having a fixed portion foldably coupled to a moving portion at a fold region with said moving portion at least partially overlapping said fixed portion defining a folded configuration, said fixed portion coupled to said one or more walls of said container portion with said fold region and said moving portion both disposed outside of said cavity, said first remote actuator unfolding about said fold region from said folded configuration in response to air entering into said second actuating volume with said moving portion moving away from said fixed portion and said first remote actuator folding about said fold region in response to air exiting from said second actuating volume, said first remote actuator biased to said folded configuration; and an air communication channel coupled to said first actuating port of said first actuating mechanism and to said second actuating port of said first remote actuator.

2. The active container of claim 1 further comprising an intake valve assembly including a first port, a second port, and a third port, said intake valve assembly providing a two-way airflow channel between said first port and said second port and a one-way airflow channel between said third port and said other ports, said one-way airflow channel communicating air from ambient to said two-way channel wherein said two-way airflow channel is installed within said air communication channel.

3. The active container of claim 2 wherein said first port is coupled to said first actuating port and wherein said air communication channel includes a conduit coupled to said second port and coupled to said second actuating port.

4. The active container of claim 1 further comprising a bleed valve operatively coupled to said air communication channel.

5. The active container of claim 4 wherein said bleed valve is disposed in said actuating balloon.

6. The active container of claim 4 wherein said bleed valve is disposed in said first actuating volume.

7. The active container of claim 4 wherein said bleed valve is disposed in said air communication channel.

8. The active container of claim 1 further comprising a bleed valve operatively coupled to said air communication channel.

9. The active container of claim 8 wherein said bleed valve is disposed in said intake valve assembly.

10. The active container of claim 1 wherein said fixed portion includes an anchor attachment coupled to said one or more walls to fix said fold region outside said container portion at a non-binding location.

11. The active container of claim 1 further comprising a flexible sheath coupled to an outside of said one or more walls, said flexible sheath concealing said portions of said first remote actuator extending outside said container portion.

12. The active container of claim 10 further comprising a flexible sheath coupled to an outside of said one or more walls, said flexible sheath concealing said portions of said first remote actuator extending outside said container portion.

13. The active container of claim 11 wherein said moving portion of said first remote actuator includes a distal end opposite of said second actuating port and wherein said distal end includes an anchor attachment coupled to said flexible sheath that fixes said fold region outside said container portion.

14. The active container of claim 1 wherein said actuator assembly is a discrete assembly.

15. The active container of claim 1 wherein said actuator assembly includes a second remote actuator configured like said first remote actuator, wherein said air communication channel is coupled to said actuating port of said second remote actuator, and wherein said first actuating mechanism concurrently operates both said first remote actuator and said second remote actuator.

16. The active container of claim 15 further comprising a lid for said opening, said lid moveably coupled to said container portion and wherein said second remote actuator is coupled to said lid to move said lid between an open configuration and a closed configuration responsive to actuation and deactuation of said actuator assembly.

17. The active container of claim 1 wherein said actuator assembly includes a second actuating mechanism configured like said first actuating mechanism and a second remote actuator configured like said first remote actuator and a second air communication channel coupling said second actuating mechanism to said second remote actuator, wherein said first actuating mechanism operates said first remote actuator without operating said second remote actuator, and wherein said second actuating mechanism operates said second remote actuator without operating said first remote actuator.

18. The active container of claim 1 further comprising a lid for said opening, said lid moveably coupled to said container portion and wherein said remote actuator is coupled to said lid to move said lid between an open configuration and a closed configuration responsive to actuation and deactuation of said actuator assembly.

19. An active container, comprising:

a container portion having a rigid inner shell defining a container cavity accessible through an opening, said rigid inner shell covered by an outside layer; and an actuator assembly, including:

a first actuating mechanism having a collapsible structure defining a first actuating volume containing a first quantity of air, said collapsible structure repeatably collapsible to expel a portion of said first quantity of air through a first actuating port of said collapsible structure, said collapsible structure automatically expanding to refill said first actuating volume;

a first remote actuator having a pair of flexible layers forming an actuating balloon defining a second actuating volume accessible through a second actuating port configured to repeatably inflate and deflate said actuating balloon, said first remote actuator having a first portion coupled to a second portion defining an unactuated configuration when said actuating balloon is deflated and defining an actuated configuration when said actuating balloon is inflated, said first portion fixed to said rigid shell with said second portion disposed outside of said container portion, said first remote actuator transitioning from said unactuated configuration to said actuated configuration in response to air entering into said second actuating volume and said first remote actuator transitioning from said actuated configuration to said unactuated configuration in response to air exiting from said second actuating volume, said first remote actuator biased to said unactuated configuration; and an air communication channel coupled to said first actuating port of said first actuating mechanism and to said second actuating port of said first remote actuator.

20. The active container of claim 19 wherein said pair of flexible layers are inelastic, wherein said actuating balloon includes a non-deformable actuating balloon, wherein said actuating balloon is folded in said unactuated configuration and at least partially unfolded in said actuated configuration, wherein said first portion includes a fixed portion, wherein said second portion includes a moveable portion coupled to said fixed portion about a fold region, and wherein both said moveable portion and said fold region are disposed at said location outside said container portion.

21. The container of claim 20 further comprising a handle portion coupled to said container portion configured to support said container portion when being carried, wherein said actuating mechanism is coupled to said handle portion.

22. A method for operating an active container, comprising:

a) carrying a container portion using a handle portion coupled to said container portion, said container portion including one or more walls defining a cavity accessible through an opening;

b) collapsing a collapsible structure coupled to said handle portion while carrying said container portion to expel a quantity of air from a first actuating volume of said collapsible structure through a first actuating port;

c) communicating an increased air pressure, responsive to said quantity of air expelled from said first actuating volume, to a remote actuator coupled to said container portion, said remote actuator having a pair of flexible layers forming a non-deformable actuating balloon defining a second actuating volume accessible through a second actuating port, said remote actuator having a fixed portion foldably coupled to a moving portion at a fold region with said moving portion at least partially overlapping said fixed portion defining a folded configuration, said fixed portion fixed to said one or more walls with said fold region and said moving portion both disposed outside of said container portion, said remote actuator unfolding about said fold region from said folded configuration in response to air entering into said second actuating volume responsive to said increased air pressure with said moving portion moving away from said fixed portion and said first remote actuator folding about said fold region in response to air exiting from said second actuating volume, said remote actuator biased to said folded configuration;

d) moving, responsive to said increased air pressure, a sheath to an operated configuration, said sheath coupled to an outside surface of said one or more walls wherein said sheath conceals said fold region and said moving portion of said remote actuator extending outside said container portion with said sheath coupled to said moving portion and having said operated configuration when said remote actuator is unfolded; and e) moving said sheath to an unoperated configuration irrespective of whether said collapsible structure is released by transitioning said remote actuator to said folded configuration by an exiting of air from said second actuating volume, said sheath having said unoperated configuration when said remote actuator is folded wherein said exiting of air includes an exit through a bleed mechanism communicated to said second actuating volume and may additionally include an exit of air by releasing said collapsible structure allowing said collapsible structure to automatically expand and refill said first actuating volume.

* * * * *